US008444366B2

(12) United States Patent
Cole

(10) Patent No.: US 8,444,366 B2
(45) Date of Patent: May 21, 2013

(54) FORKLIFT ADAPTER

(76) Inventor: Jerry Allen Cole, Riverside, CA (US)

( * ) Notice: Subject to any disclaimer, the term of this patent is extended or adjusted under 35 U.S.C. 154(b) by 216 days.

(21) Appl. No.: 12/970,396

(22) Filed: Dec. 16, 2010

(65) Prior Publication Data

US 2012/0153654 A1 Jun. 21, 2012

(51) Int. Cl.
*B66F 9/18* (2006.01)
*B66C 3/00* (2006.01)
*B66C 9/18* (2006.01)

(52) U.S. Cl.
CPC ..... *B66C 9/18* (2013.01)
USPC ..... 414/607; 414/785

(58) Field of Classification Search
USPC ..... 187/237; 294/67.33, 81.62, 119.1, 294/207; 414/279, 601, 602, 607, 664, 667, 414/673, 719, 720, 785, 796.5, 796.9; 901/16, 901/48, 49
IPC ..... B66C 1/22,1/24, 1/30, 1/42, 1/48, 1/62
See application file for complete search history.

(56) References Cited

U.S. PATENT DOCUMENTS 1,518,561 A * 12/1924 Carroll ..... 414/621
2,386,759 A * 10/1945 Ulm ..... 414/607
2,390,293 A * 12/1945 Colson ..... 294/86.41
2,512,409 A * 6/1950 Adde ..... 414/621
2,536,151 A * 1/1951 Backofen et al. ..... 414/621
2,586,843 A * 2/1952 McDonald ..... 414/621
2,690,271 A * 9/1954 Marietta ..... 414/623
2,698,764 A * 1/1955 Holland ..... 294/67.22
2,719,643 A * 10/1955 McDonald ..... 414/607
2,735,563 A * 2/1956 Kelly ..... 414/607
2,869,742 A 1/1959 Hileman
2,874,990 A * 2/1959 Janoff ..... 294/119.1
2,985,328 A 5/1961 Kitch
3,021,019 A * 2/1962 Fagrell ..... 414/796.9
3,050,206 A 8/1962 McCracken
3,076,673 A * 2/1963 Kaplan et al. ..... 294/67.33
3,319,815 A 5/1967 Vik
3,545,636 A 12/1970 Yarbrough, Jr.
3,552,557 A * 1/1971 Green ..... 414/607
3,556,328 A 1/1971 Miles
3,655,232 A * 4/1972 Martelee ..... 294/67.33
3,705,658 A 12/1972 Harris
3,850,322 A 11/1974 Miles
3,930,585 A 1/1976 Lynch (Continued)

FOREIGN PATENT DOCUMENTS

JP 8002896 1/1996

*Primary Examiner* — Saul Rodriguez
*Assistant Examiner* — Brendan Tighe
(74) *Attorney, Agent, or Firm* — Kirk A. Buhler; Buhler & Associates

(57) ABSTRACT

Improvements in a forklift adapter to offer a way of double-stacking pallets by a single forklift operator, using an existing forklift equipped with single-double forks using existing forklift controls, which is both unique and superior to using two or three people to perform the same task manually. Double-stacking pallets are accomplished by placing a sheet of material on top of a first loaded pallet of material. The blades of the forklifts slide into rectangular tubes on the forklift adapter. Sheet material is gripped by a plurality of pins on the forklift adapter where the depth of the pins is adjustable. The forklift adapter utilizes a spring that provides the gripping force. Using a spring to provide to grip provides consistent force. The spring material, coils, spring force and spring length all have factors that can change the gripping force.

15 Claims, 4 Drawing Sheets

U.S. PATENT DOCUMENTS 4,093,090 A * 6/1978 Whiteman ..... 414/607
4,095,715 A 6/1978 Reynolds
4,098,442 A 7/1978 Moore
4,290,729 A 9/1981 Cary
4,296,555 A 10/1981 Preston
4,392,772 A * 7/1983 Reeves ..... 414/667
4,395,188 A * 7/1983 Kaup ..... 414/622
4,453,873 A * 6/1984 Curti ..... 414/796.9
4,533,290 A 8/1985 Klaus-Dieter
4,637,599 A 1/1987 Eerola
4,688,981 A 8/1987 Ravnsborg et al.
4,736,971 A * 4/1988 McManus ..... 294/87.1
4,929,145 A 5/1990 Thompson
5,080,550 A 1/1992 Helbent
5,139,385 A 8/1992 Chase
5,429,490 A * 7/1995 Myers et al. ..... 425/436 R
5,682,583 A 10/1997 Reed et al.
2007/0269299 A1 11/2007 Ross
2012/0153654 A1 * 6/2012 Cole ..... 294/119.1

* cited by examiner

FORKLIFT ADAPTER

CROSS REFERENCE TO RELATED APPLICATION

This application claims the benefit of Provisional 61/245,981 filed Sep. 25, 2009 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in movement of plywood sheets. More particularly, the present forklift adapter allows a forklift operator to pick-up and set-down a single sheet of plywood without requiring the forklift operator to exit the forklift or manually handle the plywood.

2. Description of Related Art Including Information Disclosed Under 37 CFR 1.97 and 1.98

In the manufacturing and logistics industry, it is common to double-stack two pallets on top of one-another. This is used to save space as well as make loading a truck easier as the forklift operator can go back-and-fourth instead of moving laterally to load the next pallet.

In order to double-stack most pallets, a sheet of plywood needs to be inserted between two pallets. The plywood decreases and distributes the pound-per-square inch stress on the lower pallets as well as insures that the pallet above does not damage the material or packaging of the lower pallet.

In the past, it was necessary to have one or persons handle the plywood and one person to operate the forklift. Without the use of the proposed forklift adapter, floor person had to push the plywood from a stack onto the forks of the forklift. The forklift operator would drive over to the pallet and the floor person would have to set the plywood in place prior to the forklift operater being able to place a second pallet on top of the other. As such, it became a two to three-person job to stack pallets using plywood.

The present invention is designed to be used with a standard forklift equipped with single-double forks. It allows the forklift operator to use the standard controls of the forklift to pick-up a single piece of plywood without the assistance of another person, and to place that plywood on top of another pallet, all without leaving the controls of the forklift.

Several products and patents have been filed and or issued that relate to forklift or lifting adapters. Exemplary examples of patents covering these products are disclosed herein.

U.S. Pat. No. 3,319,815 issued May 16, 1967 to A. M. Vik discloses a load handling attachment for a fork lift. The attachment is a pair of curved arms for grasping the sides of a 55 gallon barrel. While this patent is for a forklift adapter it is only usable on vertical cylinders. U.S. Pat. No. 3,705,658 issued Dec. 12, 1972 to Hugh A. Harris discloses a Carpet Roll Carrier Attachment for a fork lift. The carpet carrier is essentially a horizontal tube that fits into the center of a carpet roll. This patent is only useful to lift and move rolled material.

U.S. Pat. No. 3,552,557 issued Jan. 5, 1971 to Alan William Green and U.S. Pat. No. 4,395,188 issued Jul. 26, 1983 to Otmar Kaup both disclose lifting or load carrying apparatus for use with a forklift. The apparatus basically vertically clamps materials between the forks of the forklift by installing a fixed set of forks. These patents allow the forklift to clamp and lift loads, but the bottom forks must be able to freely fit under the load that is to be lifted.

U.S. Pat. No. 4,296,555 issued Oct. 27, 1981 to Mark D. Preston and U.S. Pat. No. 4,637,599 issued Jan. 20, 1987 to Matti V. Eerola both disclose material handling equipment for handling sheet material. In both of these cases handling of the sheet material is with by applying a vacuum to the top sheet of material. The vacuum provides a suction to lift just the top sheet. While this method allows for material handling of a single top sheet, the lifting mechanism is not configured for use on a forklift and would further be difficult to secure and remove from the blades of a forklift.

What is needed is an adapter for a forklift that can be easily installed and removed without requiring an operator to leave the forklift. The forklift adapter should also enable the operator to lift just a single sheet at a time. The proposed forklift adapter provides this solution.

BRIEF SUMMARY OF THE INVENTION

It is an object of the forklift adapter to offer a way of double-stacking pallets by a single forklift operator, using an existing forklift equipped with single-double forks using existing forklift controls, which is both unique and superior to using two or three people to perform the same task manually. The forklift is capable of lifting a far greater load than a number of people and in addition can lift the load as high as the forklift is capable without human harm or injury.

The advantages are the ability to use fewer people to double-stack pallets. In addition, it is safer as only the operator of the forklift is handling the plywood and double stacking the pallets. If more than one person is used, besides the additional cost, there is a safety issue as the floor person is on the ground around an operating forklift and moving materials.

It is another object of the forklift adapter for the adapter to fit the horizontal blades of a forklift. Using the horizontal blades allows the adapter to be quickly installed and removed from the forklift. The blades of the forklifts slide into rectangular receiver tubes on the forklift adapter. The rectangular receiver tubes provide both vertical and side-to-side support. The forklift will simply align the forklift blades with the rectangular tubes of the adapter and drives the forklift blades into the rectangular tubes to install the adapter onto the forklift. Removal is performed by setting the adapter onto the ground and backing-up the forklift.

It is another object of the forklift adapter for the adapter to pick-up just a single sheet of material. The sheet is gripped by a plurality of pins where the depth of the pins is adjustable. The pins are made from bolts so they can be easily replaced, adjusted or shaped to change the grip and surface area of the grip or penetration into or on the sheet material.

It is still another object of the forklift adapter to utilize a spring that provides the gripping force. The forklift operator has limited ability to determine how much actual force is being applied to grip the sheet material. Using a spring to provide to grip provides consistent force. The spring material, coils, spring force and spring length all have factors that can change the gripping force.

Various objects, features, aspects, and advantages of the present forklift adapter will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
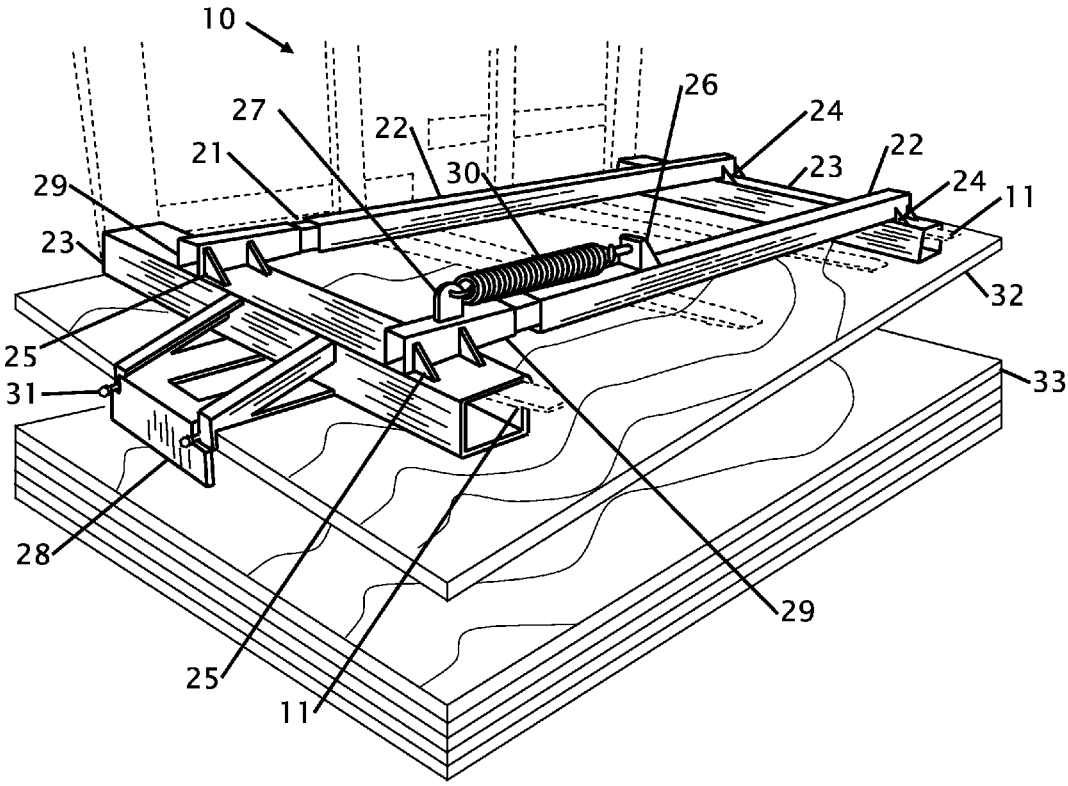
FIG. 1 shows a perspective view of the forklift adapter with a gripped sheet of plywood.

FIG. 1 shows a perspective view of the forklift adapter with a gripped sheet of plywood 32. The forklift adapter is temporally secured to a forklift 10 by inserting the blades of a forklift 11 through the plurality of receivers 23. In the preferred embodiment there are two receivers 23 that is essentially rectangular tubing that is sized to accept the horizontal blades 11 of the forklift 10. The receivers 23 are large enough in inside cross section to make locating the forklift blades 11 easy without making the inside cross sectional hole too large to create an extremely loose fit when the forklift blades 11 are placed through the receivers 23. A plurality of telescoping transverse member, 21, 22, and 29 connects the two receivers 23. The telescoping transverse members are secured to the receivers 23 in an orthogonal relationship. The method of securing these components is preferably with welding or the like. A plurality of gussets 24 and 25 provide further structural rigidity to the connection between the receivers 23 and the transverse members.

The plurality of telescoping transverse member have fixed outside transceiver members 22 with an inside transceiver member 21 that telescopes into an outside movable transverse member 29. The telescoping arrangement of the transverse members maintains a linear sliding relationship through the transverse members. In the preferred embodiment only two sets of transverse members are used but it is contemplated that more than two transverse members can be utilized. A return spring 30 is secured to at least one of the transverse member with a fixed side return spring bracket 26 and a moving side return spring bracket 27. These brackets 26 and 27 bridge the inside telescoping transverse member 21 to maintain the transverse member in a closed relationship and also to provide closing force on a plywood sheet 32 that is clamped with plywood clamps 28 and 38 (not shown).

The plywood clamps are secured to outside of the receivers 23 for a fixed side outrigger extension 38 and a movable side outrigger extension 28. The outrigger extensions include a bolt that grips into the side of a sheet of plywood 32. The blots are positioned to grip onto only the top sheet 32 of plywood from a stack 33 of plywood. Detailed figures and description of the outrigger extensions are shown and described in FIGS. 6-8. Additional disclosure on how a sheet of plywood is gripped is shown and described in FIGS. 2 and 5.

Figure 2:
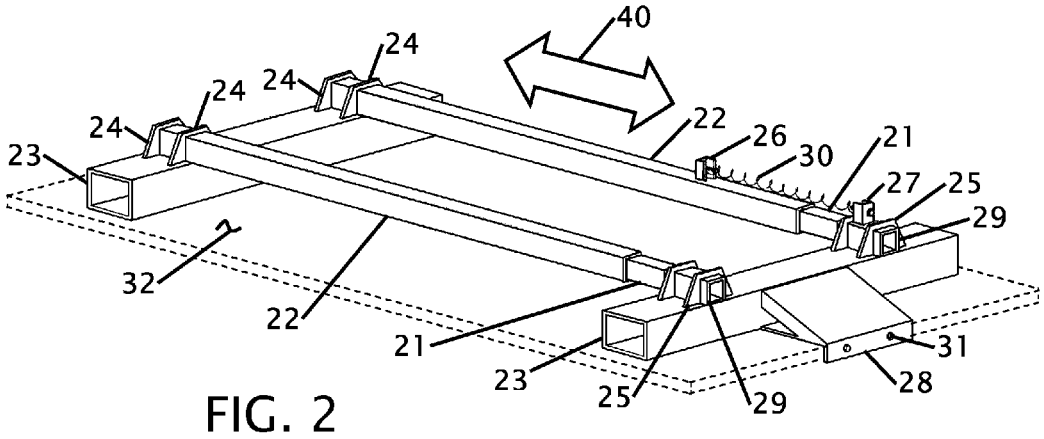
FIG. 2 is a view of the forklift adapter
Figure 3:
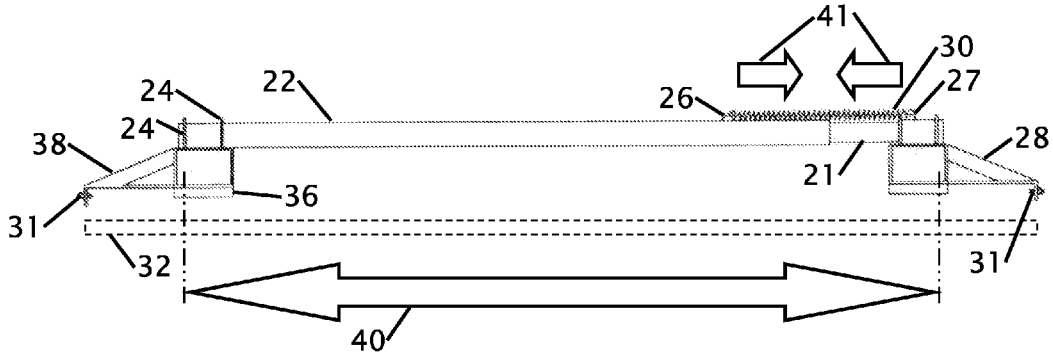
FIG. 3 is a front side view of the forklift adapter.
Figure 4:
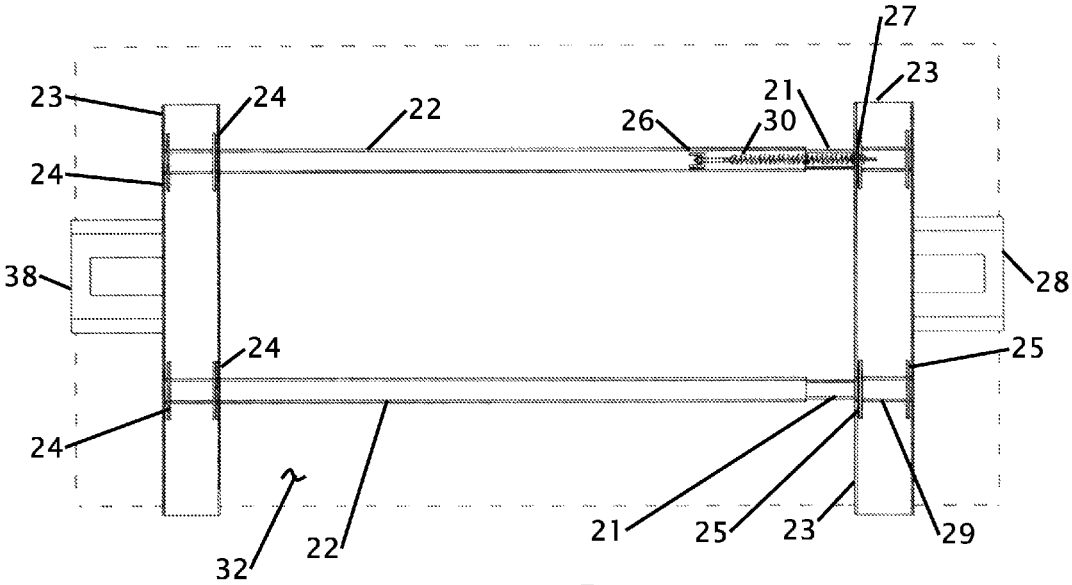
FIG. 4 is a top view of the forklift adapter.
Figure 5:
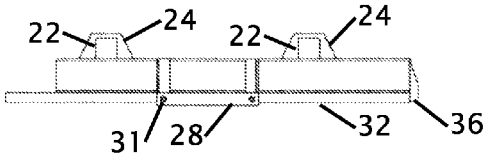
FIG. 5 is a right side view of the forklift adapter.

FIG. 2 is a view of the forklift adapter, FIG. 3 is a front side view of the forklift adapter FIG. 4 is a top view of the forklift adapter and FIG. 5 is a right side view of the forklift adapter. The forklift operator opens the unit with the forklift by opening up the forks 40. This puts positive pressure against the fork holder receivers 23 and expands the spring 30 between the fixed side return spring bracket 26 and the moving side return spring bracket 27. In the preferred embodiment only two receivers 23 are used but it is contemplated that more than two receivers 23 can be utilized. The inside transverse member tubes 21 move within the outside transverse member tubes 22 thereby opening up the outrigger extensions 28 and 38. The outrigger extensions 28 and 38 are opened wider than the size of the plywood sheet 32. The forklift adapter is then placed over a stack of plywood and lowered onto the plywood stack. A backstop or end stop 36 pushes against the elongated end of the plywood 32 and further helps orient the plywood sheet squarely under the forklift adapter.

When the operator moves the forks of the forklift closer together, the force of the return spring 30 pulls 41 the outrigger extensions 28 and 38 wood clamp to close on a single top piece of plywood 32. The spring material, coils, spring force and spring length all have factors that can change the gripping force. The bolts 31 help hold the plywood in place. The forklift operator can then raise the plywood 32 and drive to the pallet that he wants to stack. Once the plywood is over the pallet, the operator opens the forks 40, whereby expanding the moving pieces to release the plywood on top of the pallet. The operator can then either go back to the plywood pile and pick-up another piece of plywood or lower the forklift adapter unit to the ground and leave the forklift adapter and do other work activities. These FIGS. 2-5, show the gussets 24 and 25 in a second preferred embodiment where the gussets 25 and 24 wrap around the transverse moving and fixed members 29 and 22 respectively.

Figure 6:
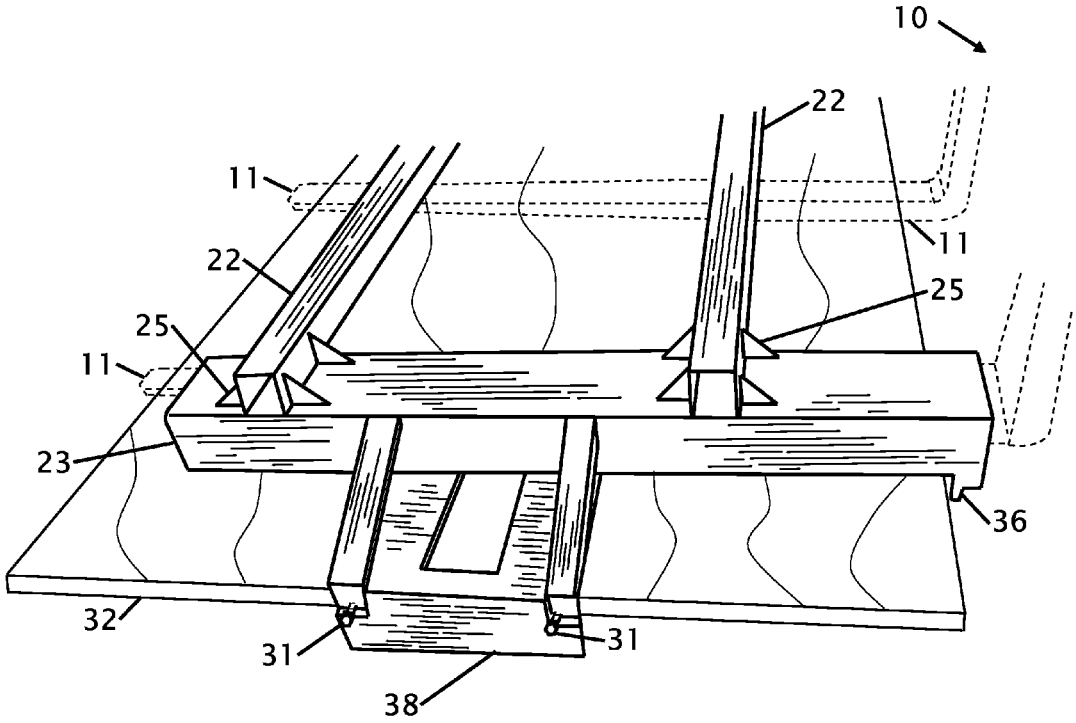
FIG. 6 is a detailed perspective side view of a gripping side of the forklift adapter.
Figure 7:
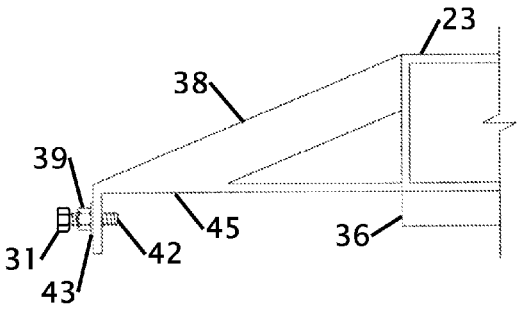
FIG. 7 is a detailed side view of the plywood gripper.
Figure 8:
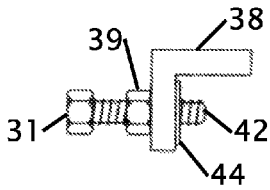
FIG. 8 is a detailed view of an angle bracket with the plywood penetration bolt.

FIG. 6 is a detailed perspective side view of a gripping side of the forklift adapter, FIG. 7 is a detailed side view of the plywood gripper and FIG. 8 is a detailed view of an angle bracket with the plywood penetration bolt. The forklift 10 and the blades 11 of the forklift 10 are shown inserted into a receiver 23. The fixed outside transverse members 22 are shown secured to the receiver 23. Multiple gussets 25 further improve the weldment of the receiver(s) 23 with the transverse member(s) 22. On the underside of the receiver 23 the back or end stop 36 is shown in contact with the elongated side of the sheet of plywood 32. An outrigger extension arm 38 is welded to the outside of each outermost receiver 23. The outrigger extension arm 38 extends the width of the forklift adapter to reach beyond outside edges of a plywood sheet 32.

The underside of each outrigger extension arm has a vertical stop 45 to allow the forklift adapter to sit flat on the top of a sheet of plywood 32 and located the bolt tip 42 at the proper height to make contact with the approximate center of a sheet of plywood 32. The outermost vertical sides of each outrigger extension extend long enough to extend beyond a single sheet of plywood and further allow for additional space for repositioning of the bolt 31 to accommodate variable thicknesses of plywood 32. The length of the exposed bolt tip 42 is adjustable by unscrewing the bolt(s) 31 from the outrigger extension arm 38 and tightening the securing jamb nut 39 or lock nut. A washer or lock washer 43 can also be utilized. It is further contemplated that a pad 44 can be utilized to further increase the frictional and gripping properties to hold a sheet of plywood 32.

Thus, specific embodiments of a forklift adapter have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A forklift adapter comprising:

a plurality of receivers for receiving forklift blades having an outermost first receiver and an outermost second receiver;

said first receiver and a second receiver being configured to accept a majority of said forklift blades to allow a forklift to adjust an angular adjustment to said first receive and said second;

a plurality of transverse telescoping members that are connected to said plurality of receivers;

a fixed outrigger extension arm that is connected to said outermost first receiver;

a moving outrigger extension arm that is connected to said outermost second receiver;

a return spring connects between said fixed outrigger extension arm and said moving outrigger extension arm;

said first outrigger extension arm and said second outrigger extension arm having a gripping means for engagement of an outside edge of at least one sheet of material and a vertical stop mechanism that limits said gripping means to engaging a predetermined number of said sheets of material of sheets of material, at least one side stop that extends from at least one of said first outrigger extension arm or said second outrigger extension arm to a dimension beyond said predetermined number of said sheets of material of sheets of material;

said side stop allows for aligned stacking of said predetermined number of said sheets of material a stack of other sheet material.

2. The forklift adapter according to claim 1 wherein said receivers are rectangular and have a hollow interior.

3. The forklift adapter according to claim 1 wherein two receivers are used.

4. The forklift adapter according to claim 1 wherein two transverse telescoping members are used.

5. The forklift adapter according to claim 1 that further includes at least one return spring.

6. The forklift adapter according to claim 1 wherein said gripping means is a bolt.

7. The forklift adapter according to claim 6 wherein said bolt is adjustable to alter a penetration into said piece of sheet material.

8. The forklift adapter according to claim 6 wherein said bolt further includes a jamb nut or lock nut.

9. The forklift adapter according to claim 1 that further includes gussets between said plurality of receivers and said plurality of transverse telescoping members.

10. The forklift adapter according to claim 1 wherein said forklift has at least two forklift blades.

11. The forklift adapter according to claim 1 wherein said sheet material is plywood.

12. The forklift adapter according to claim 1 wherein said forklift adapter allows a pallet to be double-stacked.

13. The forklift adapter according to claim 1 wherein said plurality of receivers and said plurality of transverse telescoping members are made of metal.

14. The forklift adapter according to claim 13 wherein said plurality of receivers and said plurality of transverse telescoping members are connected as a weldment.

15. The forklift adapter according to claim 1 wherein said spring is an extension spring.

* * * * *